US005529009A

United States Patent [19]

Faury et al.

[11] Patent Number: 5,529,009

[45] Date of Patent: Jun. 25, 1996

[54] DISPLACEMENT AND MULTIHULL SHIP WITH LIMITED TRANSVERSE RECTIFYING TORQUE AND WITH REDUCED RESISTANCE TO FORWARD MOTION

[75] Inventors: Franç ois Faury; Jean-Eric Enault, both of Seine-Maritime, France

[73] Assignee: Societe Nouvelle des Ateliers et Chantiers Du Harve, Seine-Maritime, France

[21] Appl. No.: 380,246

[22] Filed: Jan. 10, 1995

Related U.S. Application Data

[63] Continuation of Ser. No. 822,277, Jan. 21, 1992, abandoned.

[30] Foreign Application Priority Data

Jan. 18, 1991 [FR] France ..... 91 00569
Apr. 17, 1991 [FR] France ..... 91 04724

[51] Int. Cl.[6] ..... B63B 1/12
[52] U.S. Cl. ..... 114/61; 114/123
[58] Field of Search ..... 114/61, 123, 283

[56] References Cited

U.S. PATENT DOCUMENTS

| | | | |
|---|---|---|---|
| 2,745,370 | 5/1956 | Manis . | |
| 2,781,735 | 2/1957 | Roberts & Rountree . | |
| 3,528,380 | 9/1970 | Yost . | |
| 3,623,444 | 11/1971 | Lang | 114/61 |
| 3,768,429 | 10/1973 | Greer | 114/61 |
| 3,842,772 | 10/1974 | Lang | 114/61 |
| 3,847,103 | 11/1974 | Takeuchi | 114/61 |
| 4,827,859 | 5/1989 | Powell | 114/61 |

FOREIGN PATENT DOCUMENTS

| | | | |
|---|---|---|---|
| 521518 | 10/1980 | Australia . | |
| 1432295 | 12/1966 | France . | |
| 2540063 | 8/1984 | France | 114/61 |
| 2552046 | 3/1985 | France . | |
| 2567095 | 1/1986 | France . | |
| 2607772 | 6/1988 | France . | |
| 3104953 | 12/1982 | Germany . | |

*Primary Examiner*—David A. Bucci
*Assistant Examiner*—Thomas J. Brahan
*Attorney, Agent, or Firm*—Larson & Taylor

[57] ABSTRACT

A ship having main hull 2 and at least one side hull provided to correspond to the inequality $$\sum_{i=1}^{n} S_i(d_i)^2 < 0.8\Delta(4+BG)$$

in which n is the number of hulls, $S_i$ the surface area of the cross section of the side hull at the floatation, $d_i$ the side distance between the longitudinal axis of the hull No. i and the longitudinal axis of the main hull 2, Δ the displacement of the ship, 4 the module of stability and BG the distance between the center of the displacement B and center of gravity G of the ship.

20 Claims, 2 Drawing Sheets

DISPLACEMENT AND MULTIHULL SHIP WITH LIMITED TRANSVERSE RECTIFYING TORQUE AND WITH REDUCED RESISTANCE TO FORWARD MOTION

This application is a continuation of application Ser. No. 08/822,277 filed Jan. 21, 1992 now abandoned.

The present invention relates to a particular embodiment of a displacement ship intended for high speed navigation and likely to be used for different purposes, for example as a commercial ship, military ship and/or pleasure boat.

In order to make high speed ships, it is known that it is advantageous to use hulls with a very great length/width ratio, but in order to obtain high performance these hulls would be quite unstable and therefore not usable.

It is known in order to remedy this disadvantage, to use side floats, such as in the so called trimaran ships including two side floats or two sets of side floats.

The disadvantage of the trimaran ships resides notably in the fact that their return torque for very small angles of list is extremely high with respect to that of a single hull ship of standard construction. The result is that the ship is made uncomfortable, that the efforts applied to its structure are increased, and that the ship is made sensitive to a choppy sea of small amplitude.

The invention solves the foregoing problem by allowing the production of displacement trimaran ships using a central float with a very large length/width ratio and side floats which generate, as a function of the angle of list, progressive return torques similar to the rectifying torques of a single hull ship.

According to the invention, a displacement and multihull ship with limited transverse rectifying torque including a central float connected to at least two side floats, is characterized in that, for any horizontal section in the area extending over a height of at least 6% of the distance from the axes of the floats to the axis of the ship above and below any navigation water line of the ship, the shapes of the horizontal sections of the side floats are such that the sum, for all of the side floats, of the products, for each float, of the surface expressed in square meters of its horizontal cross section, multiplied by the square of the distance expressed in meters, from its axis to the axis of the ship, does not exceed the product of 80% of the ship weight expressed in metric tons multiplied by the sum of the number 4 and of the distance expressed in meters between the centre of the displacement and the centre of gravity of the ship, in that at least one side float on each side of the central float is partially immersed at a zero speed, and in that the central float has, for any navigation water line, a width/draught ratio at least equal to 1 and a length/width ratio at least equal to 8.

So constructed, the ship becomes comfortable under rolling and is therefore particularly adapted to the transportation of passengers and of delicate goods.

Moreover, comfort is further improved by the addition of stabilizing fins on the inner face of the side floats. The attribute of the invention which provides the ship with return torques as a function of the angle of list which are much smaller than those of the other multihull ships, allows the installation of fins of small surface, therefore offering a small resistance to propulsion. Finally, since such fins can be positioned on the inner faces of the side floats, they do not need to be retractable, which reduces their cost.

Various other features of the invention will become more apparent from the following detailed description.

Embodiments of the object of the invention are shown by way of non-limiting examples in the accompanying drawings.

Figure 1:
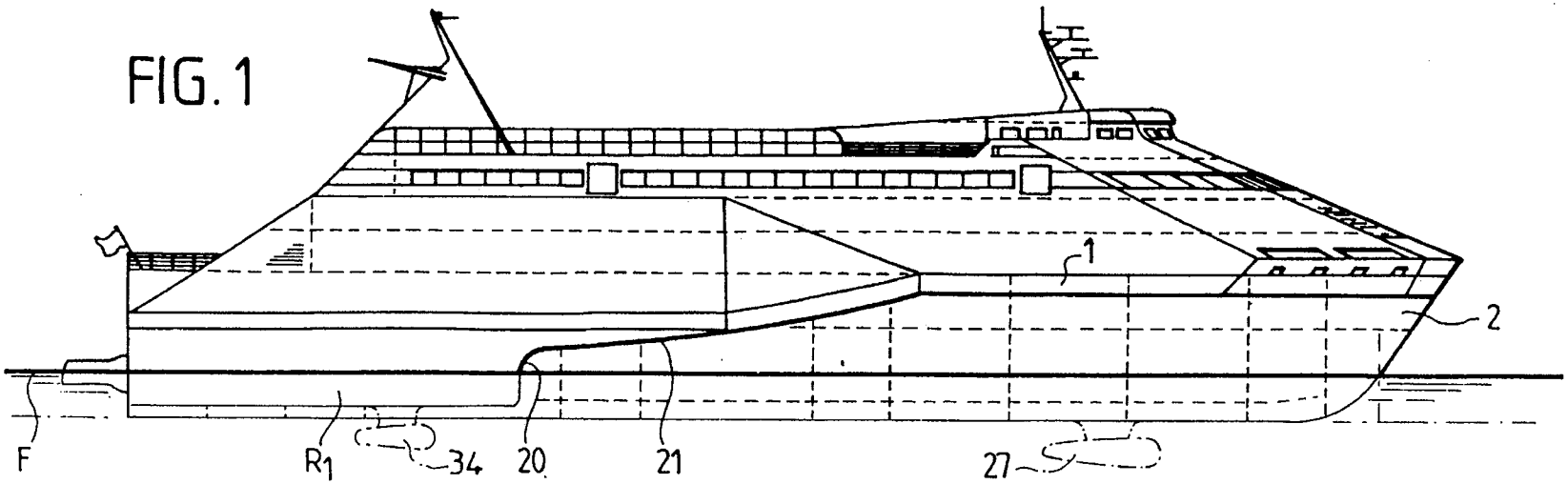
FIG. 1 is a side elevation view of a ship to which the invention is applied.
Figure 2:
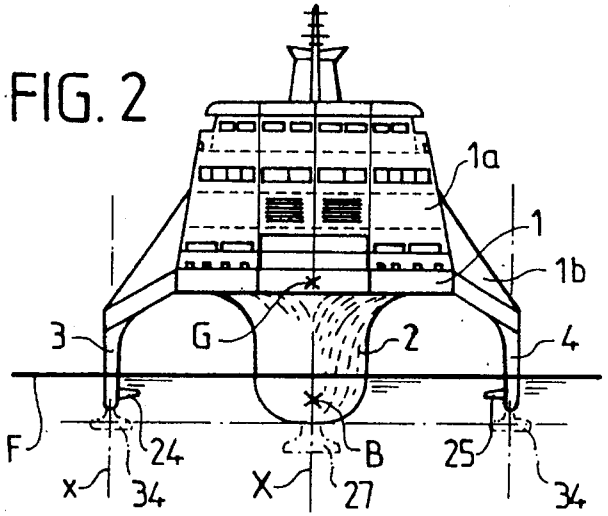
FIG. 2 is frontal view from the front of the same ship.
Figure 5:
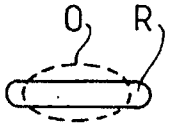
FIG. 5 is a sectional schematic view along line V—V of FIG. 3 showing that the shape of the horizontal sections of some of the hulls of the ship may have particular shapes.

The ship shown in FIGS. 1 and 2, which is of the displacement type, includes a central float 2 connected to side floats 3, 4. The central float 2 supports a platform 1 which can be advantageously used for providing a connection with the side floats 3, 4.

In FIG. 1, the platform 1 supports a strong structure la forming arms or arches **1*b*** for a connection with the side floats.

The central float or hull has at least at the level of its water line for all navigation conditions, a great length/width ratio, this ratio being at least equal to 8. By way of example, for a ship of an overall length on the order of 100 meters, the width of the water line at the level of the main beam of the central float is advantageously on the order of 8 meters.

Within the scope of the invention and so that the ship does not list when stopped, it is necessary to provide on each side of the central float at least one side float partially immersed when the ship is not moving. The side floats form stabilizers and are made so as to have as a whole a small displacement which has to be at most equal to 20% of the total displacement of the ship. Likewise, the surface of floatation of the side floats has to be small and has to correspond advantageously to at most 15% of the total surface of floatation of the ship. Still further, in a static position, the initial useful length of the side floats 3, 4 is advantageously at most equal to 40% of the length of floatation of the central float 2. Regarding the central float, the ratio of its width and draught has to be at least 1 whatever the level of the water line and the navigation conditions, that is for any navigation water line.

According to the invention, it is essential that for any horizontal section in the area extending over a height of at least 6% of the distance between the axes x of the side floats and the axis X of the central float above and below any navigation water line of the ship, the shapes of the horizontal sections of the side floats is such that the sum, for the whole of these floats, of the products for each float, of the surface expressed in square meters of its horizontal section multiplied by the square of the distance expressed in meters from its axis x to the axis X of the ship does not exceed the product of 80% of the ship weight expressed in metric tons multiplied by the sum of the number 4 and of the distance expressed in meters between the centre of displacement B and the centre of gravity G of the ship.

In other words, the ship must correspond substantially to the inequality.

$$\sum_{i=1}^{n} S_i(d_i)^2 < 0.8\Delta(4+BG)$$

in which:

n=number of side hulls.

$S_i$=surface area of the cross section of the side hull No. i at its floatation.

$d_i$=side distance between the longitudinal axis of the hull No. i and the longitudinal axis of the ship.

Δ=displacement or weight of the ship.

4=Module of stability.

BG=Distance between the center of the displacement B and the center of gravity G of the ship.

Within the constraints of the foregoing inequality relationship, horizontal cross sections of the side floats can vary so as to be adapted to particular navigation and construction conditions.

Figure 3:
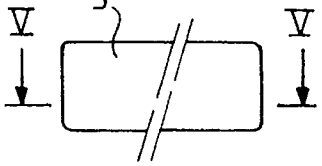

FIG. 3 shows that the side floats, for example float 3, have in elevation a general rectangular shape and that their horizontal cross section, that is as seen a long line V—V, is made in the shape of a rectangle R with small rounded and thinned out sides in order to have convenient hydrodynamic qualities. A shape of an ovoid or of a wing is appropriate from a hydrodynamic point of view.

Figure 10:
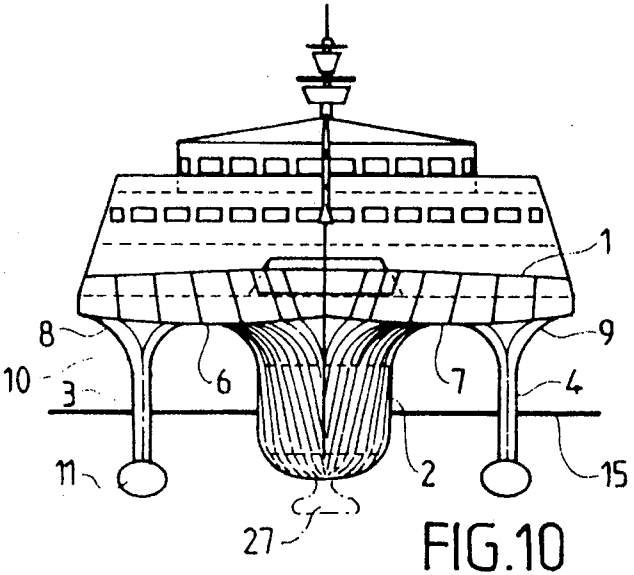
FIG. 10 is a frontal view corresponding to FIG. 9.

In a preferred embodiment, the side floats have a horizontal section which remains substantially constant over a major portion of their height as is shown in FIGS. 2 and 10.

FIG. 1 shows that in elevation, the side floats can be complex shapes, for example a portion substantially rectangular $R_1$ extending on either side of the water line F, then at the anterior portion a stem 20 extending into an oblique portion 21.

Figure 4:
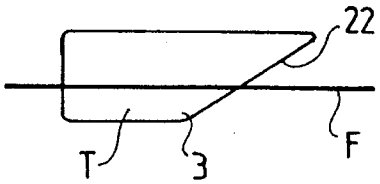
FIGS. 3 and 4 are schematic illustrations of particular shapes of the ship side stabilizing hulls.

FIG. 4 shows that the side floats can more simply have an immersed portion 1 substantially trapezoidal and extended by an inclined prow 22.

Figure 7:
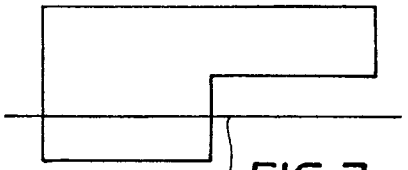
FIGS. 7 and 8 are schematic illustrations of particular side hulls for the ship.

FIG. 7 shows that the side floats can define two contiguous volumes without progressivity.

Figure 6:
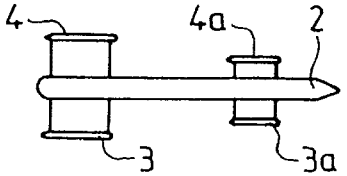
FIG. 6 is a schematic view from above of a ship according to the invention but having a different number of side hulls.
Figure 8:
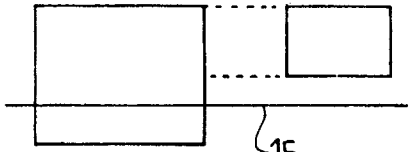

FIGS. 6 and 8 show that the side floats can define two non contiguous volumes.

Other shapes in elevation can be used as long as they do not modify the foregoing inequality relationship, that is as long as these shapes do not generate a high rectifying torque for small angles of list, but that this torque increases as the angle of list increases. In other words each side float, or group of side floats, has progressive floatability levels:

1st level: for a small angle of list where the first level of floatability alone intervenes on each side float.

2nd level: for a larger angle of list where one of the floats can be no longer immersed and the other float, as a compensation, reaches an increased region of floatability.

In FIGS. 1 and 2, the ship is shown as including only two side floats 3, 4. This condition is not imperative.

FIG. 6 shows by way of example that the central float 2 is connected at its rear portion to two side floats 3, 4 and at its front portion to two side floats 3*a*, 4*a* with a spacing which is advantageously but not necessarily different than the spacing of the side floats 3, 4.

By way of example, the ship shown in FIGS. 1 and 2 includes advantageously a central hull 2 of an overall length of about 100 meters for a length at the water line of about 95 meters. In that case, the water line width at the main beam of the central hull would be of the order of 8 meters, the axis x of the side hulls would be substantially at 15 meters from axis X of the central hull and the cross section of the rectangular portion $R_1$ would be substantially that of a rectangle of one meter in width and of a length of the order of 30 meters. The portion of the height of the side floats having a substantially uniform cross section would be in this case about 5 meters.

As shown in FIG. 2, the side floats can be advantageously provided with roll stabilizers with fins 24, 25 placed preferably inside the floats.

In particular, since the construction according to the invention provides the ship with return torques which are a function of the angle of list and are clearly smaller than all the other multihull ships, this allows the fins to be of small surface, and therefore offering a small resistance to forward travel. Since the fins can be placed on the inner faces of the side floats, they do not need to be retractable when the ship reaches a wharf, or is under other circumstances, which reduces their cost.

Likewise, FIGS. 1 and 2 show that at least one pitch stabilizer 27 can be fixed underneath the central hull and preferably in its front portion. The stabilizer 27 can be of any active type, that is a mobile fin which is piloted or controlled by the pitch movements, or of a passive type, that is with a fixed fin.

Figure 9:
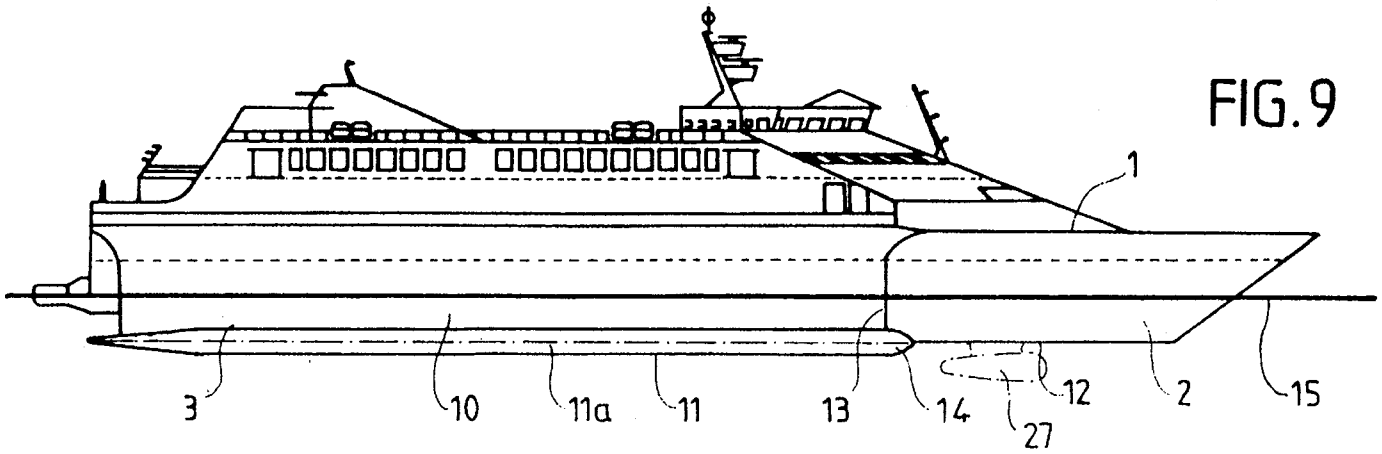
FIG. 9 is an elevation view similar to that of FIG. 1 of an alternative embodiment.

Another embodiment is shown in FIGS. 9 and 10 where the central float 2 has the shape of a thin hull with a great length/width ratio (LB), the apex of which is connected on the one hand below platform 1 or to any other connection means, and on the other hand to the side floats 3, 4.

The connection between the central float 2 and the side floats is preferably provided by defining arches 6, 7 and each float is on the other hand connected to the platform via an arch element 8, respectively 9.

It results from the foregoing that the side floats have a floatability which increases in a continuous manner up to the platform 1.

Each side float may be made of a thin wall 10 at the lower end of which is provided a body 11 of substantially cylindrical shape of circular or elliptical section as shown in FIG. 10.

When the side floats are provided in their portion with bodies 11, it is advantageous that their axis 11*a* (FIG. 9) is in alignment or substantially in alignment with the keel line 12 of the central float.

The means explained hereabove and the spacing of the side floats are chosen so that they provide the ship with the transverse stability which is just necessary but optimum under normal navigation conditions, that is as long as the height of the waves does not reach the beginning of the arches 6, 7 and of the arch elements 8 when these are provided.

The structure of a ship according to the invention is such that the central float can have water lines which are very fine and stretched, and favorable at a great displacement speed, and that the side floats of great height, for example from 5 to 10 m for a ship of 100 m, are always sufficiently immersed so as to make the ship little sensitive to the effects of swell. Moreover, the small width of the side floats which is advantageously of the order of 1 meter for a ship of a length of about 100 meters, is such that the side floats generate only a small quantity of waves, thereby facilitating the advance of the ship.

FIG. 10 shows that the side floats have a small width which is practically constant over the major portion of their height. Thus, the hydrostatic return which they create as soon as the ship is transversely inclined is not too great so that the ship appears comfortable when rolling.

It is advantageous as shown in the drawing, and particularly in FIG. 9, that the stem 13 of the wall 10 is positioned rearwardly with respect to the front end of body 11 so as to form a bulb 14.

When the width of the side floats is of the order of 1 meter, the width of the bodies 11 is of the order of 2 to 3 meters so that these bodies when completely immersed form damping elements as regards the rolling, pitch and pounding movements to which the ship is subjected. The great length of the central float 2 and of the side floats 3, 4 forms on the other hand extremely efficient anti-drift surfaces which allow propulsion of the ship by sails.

In the drawing and particularly in FIG. 10, the floats 3, 4 are shown with a width substantially constant. In practice, the width can be variable.

The wall of each side float is shown as a single piece. If required, the wall can be partly opened or made of successive arms.

The propulsion of the ship is preferably mechanical (propeller or water jet, for example) although propulsion by sails could also be easily provided since it possible to have an influence on the transverse stability by choosing in an appropriate manner the spacing between the central float and each of the side floats which can moreover be provided with ballast for compensating for list.

Figure 11:
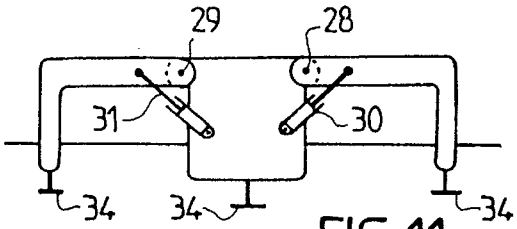
FIGS. 11 and 12 are schematic views showing particular embodiments.

An advantageous development of the invention consists, as shown in FIG. 11, in articulating the side floats 3, 4 about longitudinal axes 28, 29 and controlling the position of the floats by cylinders 30, 31. According to the variant of FIG. 12, the side floats include telescopic portions 31, 41 controlled by cylinders 32, 33.

In addition to the stabilizer 27, support surfaces 34, which are settable or not, can be placed on the side floats as well as on the central float in order to create a dynamic lift and also in order to form roll and pitch stabilizers by controlling the ship trim. Moreover, flexible skirts can be provided between the central float and the walls of the side floats in order to create air inlet tunnels so as to form lifting and damping cushions.

Figure 12:
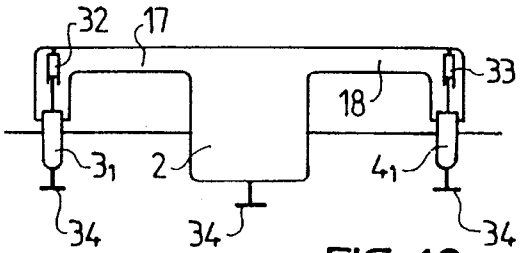

In the foregoing, according to an advantageous development of the invention, the platform 1 forms a hull for carrying loads. It is possible for certain applications to replace the platform by any connection means, for example arms 17, 18 (FIG. 12). The arms 17, 18 can be made of successive transverse beams or of a continuous web.

What is claimed is:

1. In a displacement and multi-hull ship having a navigation water line (F), comprising a central float having a longitudinal axis (X) connected to at least two side floats, each side float having a longitudinal axis (x), the improvement wherein:

said central float has a large length/width ratio and a low roll stability, and said side floats have a horizontal section substantially constant over a major portion of their height; and wherein for any horizontal section in the area extending over a height of at least 6% of the distance from the axes (x) of the floats to the axis (X) of the ship above and below any navigation water line (F) of the ship, the shapes of the horizontal sections of the side floats are such that the sum, for all of the side floats, of the products, for each float, of the surface expressed in square meters of its horizontal cross section, multiplied by the square of the distance expressed in meters, from its axis (x) to the axis (X) of the ship, does not exceed the product of 80% of the ship weight expressed in metric tons by the sum of the number 4 and of the distance expressed in meters between the center of displacement (B) and the center of gravity (G) of the ship;

wherein at least one side float on each side of the central float is partially immersed at zero speed; and wherein the central float has, for any navigation water line, a width/draught ratio of at least equal to 1 and a length/width ratio at least equal to 8.

2. A ship according to claim 18 having two side floats, the displacement of said floats being at most equal to 20% of the total displacement of the ship.

3. A ship according to claim 1 wherein said side floats have a flotation surface which is less than 15% of the total flotation surface of said ship.

4. A ship according to claim 1 wherein said side floats have a length at most equal to 40% of the flotation length of said central float.

5. A ship according to claim 1 wherein the geometrical shape of the horizontal section of said side floats is rectangular.

6. A ship according to claim 1 wherein the geometrical shape of the horizontal section of said side floats is ovoid.

7. A ship according to claim 1 wherein said side floats include a portion which is of substantially rectangular shape in elevation, said portion being extended by a stem leading to a rectilinear portion extending toward the front of the ship.

8. A ship according to claim 1 wherein said side floats include a portion which is of substantially rectangular shape in elevation, said portion being extended by an stem leading to a oblique portion.

9. A ship according to claim 8 wherein said oblique portion extends toward the front of the ship.

10. A ship according to claim 1 wherein said side floats are generally rectangular in elevation.

11. A ship according to claim 1 wherein said side floats have a trapezium-shaped portion connected to an inclined prow.

12. A ship according to claim 1 wherein said side floats each have, in their lower portion, a substantially cylindrical body.

13. A ship according to claim 1 wherein said side floats each have, in their lower portion, a substantially elliptical body.

14. A ship according to claim 12 wherein said body protrudes beyond the stem of said floats so as to define a bulb.

15. A ship according to claim 1 wherein said side floats are articulated and wherein said ship further comprises means for displacing said floats about axes (28, 29).

16. A ship according to claim 1 wherein said side floats comprise telescoping portions, and wherein said ship further comprises means to move said telescoping float portions.

17. A ship according to claim 1 wherein said floats further comprise stabilizing and supporting surfaces (27, 34).

18. A ship according to claim 1 wherein said side floats contain ballast.

19. A ship according to claim 1 wherein roll stabilizing fins are provided on the inner faces of the side floats.

20. A ship according to claim 1 wherein said ship has an overall length of about 100 meters, the central float has a length at the level of the water line of about 95 meters and a main beam at the water line of about 8 meters, the axis (X) of the central float space being spaced from the axis (x) of the side floats by 15 meters, and the length of the side floats being on the order of 30 meters, while the width of each of said side floats is on the order of 1 meter and their height is about 5 meters.

* * * * *